United States Patent [19]

Hirota et al.

[11] Patent Number: 4,679,952

[45] Date of Patent: Jul. 14, 1987

[54] PRINTING APPARATUS INCLUDING TAB POSITION PLACEMENT CONTROL

[75] Inventors: Satoshi Hirota; Kimihiro Nagamine, both of Tokyo, Japan

[73] Assignee: Casio Computer Co., Ltd., Tokyo, Japan

[21] Appl. No.: 797,423

[22] Filed: Nov. 12, 1985

[30] Foreign Application Priority Data

Dec. 21, 1984 [JP] Japan ..... 59-270160

[51] Int. Cl.[4] ..... B41J 21/14

[52] U.S. Cl. ..... 400/279; 400/285.4

[58] Field of Search ..... 400/279, 285, 285.4

[56] References Cited

U.S. PATENT DOCUMENTS 3,885,663 5/1975 Suzuki ..... 400/279
4,495,600 1/1985 Kikuchi et al. ..... 400/279 X

FOREIGN PATENT DOCUMENTS 1438391 6/1976 United Kingdom ..... 400/279
1438392 6/1976 United Kingdom ..... 400/279
1439529 6/1976 United Kingdom ..... 400/285.4

OTHER PUBLICATIONS

IBM Technical Disclosure Bulletin, "Text Formatting", Kolpek, vol. 16, No. 2, Jul. 1973, pp. 391-394.

*Primary Examiner*—Ernest T. Wright, Jr.
*Attorney, Agent, or Firm*—Frishauf, Holtz, Goodman & Woodward

[57] ABSTRACT

A printing apparatus wherein character data to be tabulated is input. Data representing the printing position of a specified digit of one piece of character data is input in a tab memory. Then, data designating a tab operation is supplied to an address converting circuit. In accordance with this data, the address converting circuit converts the addresses of the pieces of character data such that the specified digit of every piece of character data is printed at the position represented by the data stored in the tab memory.

2 Claims, 4 Drawing Figures

PRINTING APPARATUS INCLUDING TAB POSITION PLACEMENT CONTROL

BACKGROUND OF THE INVENTION

The present invention relates to a printing apparatus including tab position placement control for printing characters, symbols and numerals and, more particularly, to a printing apparatus with which input data can be efficiently corrected.

To prepare a table of numbers by using printing apparatuses, e.g., typewriters or word processors, the decimal points of numbers or the rightmost positions of numbers having no decimal points must sometimes be aligned.

For example, to print decimal number "123.456" by using a conventional manual or electrical typewriter, the typist sets a tab position where the decimal point should be printed. He or she then depresses the tab key, whereby the print head is moved to the tab position. The typist pushes the back-space key three times, returning the print head for a three-character distance. Then, he or she depresses the "1", "2", "3", ".", "4", "5", and "6" keys in this order, thus printing the decimal number with the decimal point printed at the tab position.

Electronic typewriters which have a memory, can store a document and can process the stored document, have recently become popular. Some of them are equipped with a so-called decimal tab key, "DEC TAB". To print decimal number "123.567" with the decimal point at a desired tab position, the typist first sets the desired tab position. He or she then pushes the "DEC TAB" key and depresses the "1", "2", "3", ".", "4", "5" and "6" keys. When the period key, "." is pushed, the data representing "123." is stored in the memory in such a manner that the decimal point will be printed in the tab position. When the return key, "RET", is finally depressed, the typewriter prints "123.456," with the decimal point at the tab position. To print the whole number "123", the typist depresses the "DEC TAB", "1", "2" and "3" keys, and the space key, "SPC". When the space key "SPC" is pushed, the data representing "123-" is stored in the memory in such a manner that the space will be located in the tab position. (Symbol "-" indicates a space.) When the return key, "RET", is depressed, the typewriter prints the whole number, with the space located at the tab position.

The electronic typewriters described in the preceding paragraph have a drawback. Let us assume that the typist has set the tab position at the tenth printing position and has mistakenly depressed the "1", "2" and "." keys after depressing the "DEC TAB" key, intending to print "123." In this case, the data stored in the memory is, "- - - 12." The typist must depress the cursor key, "←" ten times and then depress the "1", "2", "3" and "." keys, in order to change this incorrect data to the correct data, "- - - 123." This cumbersome operation is required since, the cursor moves to the selected tab position when the "." key or "SPC" key is depressed after the "DEC TAB" key has been depressed.

SUMMARY OF THE INVENTION

It is an object of the present invention to provide a printing apparatus which is free from the above drawbacks and can easily correct input data.

In order to achieve the above object according to the present invention, there is provided a printing apparatus comprising: tab setting means for setting a predetermined digit position in a character data string; means for inputting the character data string and data for designating execution of tab operation after inputting the character data string; memory means, connected to the input means, for storing the character data string and the data for designating execution of the tab operation; address converting means for converting addresses of the character data string stored in the memory means based upon the predetermined digit position set by the tab setting means after the data for designating execution of the tab operation is inputted; and printing means for printing the character data string which is address-converted by the address converting means so as to correspond to the predetermined digit position.

With the above arrangement, the printing apparatus of the present invention performs digit alignment for the tab operation so that the data for designating execution of the tab operation corresponding to an input operation of a decimal tab key, is inputted after the character data string to be subjected to the tab operation is inputted. That is, when a character data string is inputted, no specific operation associated with tab operation is performed, and the character data string is simply stored in the memory means. Therefore, input data can be easily corrected as in the case of a normal key input operation.

DETAILED DESCRIPTION OF THE PREFERRED EMBODIMENTS

Figure 1:
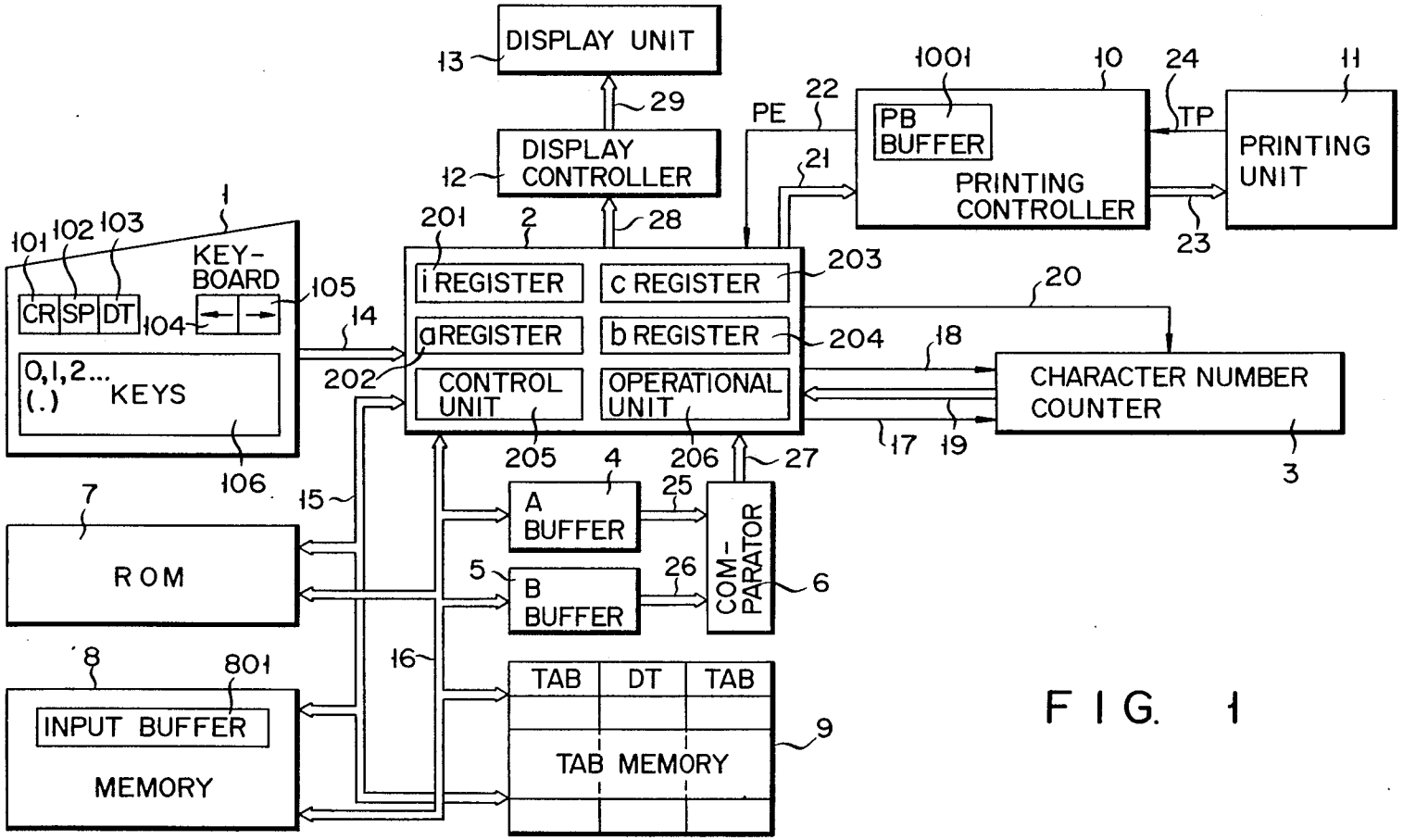
FIG. 1 is a block circuit diagram showing a printing apparatus according to an embodiment of the present invention.

FIG. 1 shows the overall configuration of a printing apparatus according to the present invention.

A keyboard 1 has a carriage return key (CR) 101, a space key (SP) 102, a decimal tab key (DT) 103, left and right cursor moving keys 104 and 105 and other keys 106. An output from the keyboard 1 is connected to a central processing unit (CPU) 2 through a data bus 14. The CPU 2 has an "i" register 201, an "a" register 202, a "c" register 203, a "b" register 204, a control unit 205 and an operational unit 206. The CPU 2 is connected to a display controller 12 through a data bus 28, and the controller 12 is connected to a display unit 13 through a data bus 29. The CPU 2 is connected to a read-only memory (ROM) 7, a document memory 8 and a tab memory 9 through an address bus 15 and a data bus 16. The CPU 2 is connected to an A buffer 4 and a B buffer 5 through the bus 16, and the buffers 4 and 5 are connected to a comparator 6 through data buses 25 and 26. An output from the comparator 6 is connected to the CPU 2 through a data bus 27. The CPU 2 is connected to a printing controller 10 through a data bus 21 and a signal line 22, and the controller 10 is connected to a printing unit 11 through a data bus 23 and a signal line 24. The CPU 2 is connected to a character number counter 3 through signal lines 17, 18 and 20, and the output from the counter 3 is connected to the CPU 2 through a data bus 19. On the other hand, the memory 8 has an internal input buffer 801, and the controller 10 has an internal PB buffer 1001.

The operation of the printing apparatus with the above arrangement will be described with reference to an operation flow chart of FIG. 2 and illustrations of FIGS. 3 and 4.

First, the operation will be briefly explained. FIG. 3 shows a case wherein printing is performed so that a decimal point of input numeral data is aligned at a 15th digit, as shown in a printing format thereof. The buffer 801 temporarily stores key input codes from the keyboard 1 (FIG. 1) from the leftmost position. Assume that a 15th digit is stored in advance in the memory 9 of FIG. 1 as a decimal tab position (to be referred to as a DT position hereinafter). Referring to FIG. 3, "a", "b", "c", "d", "e" and "f" are normal key inputs, and are printed at first to 6th digits without changing the printing format. When numeral "123.456" is to be printed so that its decimal point is aligned at the 15th digit in accordance with the printing format, after the space key "SP" (102 in FIG. 1) is depressed the keys "1", "2", "3", ".", "4", "5" and "6" are operated. Subsequently, the decimal tab key "DT" (103 in FIG. 1) and the carriage return key "CR" (101 in FIG. 1) are depressed. Thus, the CPU 2 (FIG. 1) discriminates that a numeral string between the space key code SP at the seventh digit and the decimal tab key code DT at the 15th digit on the input buffer 801 is to be aligned at the decimal tab position. The CPU 2 then discriminates that the total number of characters of this numeral string is seven, and thereafter, discriminates the decimal point at the 11th digit on the input buffer 801. Thus, the numeral having seven characters is printed to be entirely shifted so that the decimal point is printed at the preset 15th digit on the printing format. According to the present invention, the "DT" key 103 is operated after inputting numerals. As long as the "DT" and "CR" keys 103, 101 are not detected, the input key codes are simply stored in the input buffer 801, and tab operation is not performed. For example, when "123.456" is to be inputted as in the above case, even if erronenous key input operation is performed, e.g., "1", "2", ".", as long as the "DT" key 103 is not operated, the input data can be corrected as in normal correction of characters. That is, in this case, a cursor (not shown) is moved to the left by one character by using the left cursor key 104 (FIG. 1) so as to delete the "." code, and then, keys "3", ".", "4", "5" and "6" can be operated again. In this manner, according to the present invention, in the decimal tab operation, numeral input can be easily corrected in the same manner as in the normal character key input operation, without requiring cumbersome operation as with a conventional apparatus.

The operation of the printing apparatus shown in FIG. 1 will be described with reference to the flow chart shown in FIG. 2. The decimal tab position (the DT position) is stored in advance in the tab memory 9 through the keyboard 1. In an example shown in FIG. 3, since the DT position is set at the 15th digit, the numeral stored in the tab memory 9 is "15". Then, key input is performed using the keyboard 1 as follows: "a", "b", "c", "d", "e", "f", "SP", "1", "2", "3", ".", "4", "5", "6", "DT", "CR". Thus, the corresponding key codes are stored in the input buffer 801 of the memory 8, as shown in FIG. 3. The unit 205 of the CPU 2 starts the flow chart shown in FIG. 2 after operation of the "CR" key 101 (FIG. 2, step 1). Then, the unit 205 detects the DT code in the input buffer 801 using the address bus 15 and the data bus 16, and sets an addess i=15 thereof in the a register 202 (FIG. 2, step 2). The register 202 stores the preset digit address of the input DT code in the input buffer 801. As will be described later, an address of the rightmost numeral code of the numeral data at the left of the DT code set in the input buffer 801 is set. In this case, the storage content of the "i" register 201 which similarly stores the digit address of the DT code on the input buffer 801 is updated to i=15. Therefore, it can be detected that the digit address of the rightmost numeral code in the input buffer 801 is "14". The address of the leftmost numeral code of the numeral data at the right of the SP code in the input buffer 801 is set in the "i" register 201. In order to detect the address of the leftmost code of the numeral data in the input buffer 801, the SP code is detected. For this purpose, the SP code is read out from the ROM 7, and is set in the A buffer 4. The A buffer 4 temporarily stores the input SP code or the decimal point code. Then, the unit 205 reads out the numeral code M(i) at the address i in the input buffer 801 and stores it in the B buffer 5 (FIG. 2, step 5). In this case, since a content of the "i" register 201 is a value decremented by one by the unit 206, i.e., the storage content of the "i" register 201 is "i=15" by the processing of FIG. 2, step 2, the read address of the numeral code M(i) is a value obtained by subtracting 1 from 15, i.e., i=14. Therefore, as shown in the input buffer 801 of FIG. 3, the numeral code M(14) at the corresponding address is the numeral code "6" at the 14th digit. The contents of the A and B buffers 4 and 5 are compared by the comparator 6 with each other through the data buses 25 and 26.

It is compared whether or not the data read out from the input buffer 801 to the B buffer 5 is equal to the space code SP as the content of the A buffer 4. In this case, since the content of the B buffer 5 is the numeral code 6, coincidence cannot be detected, and a noncoincidence signal is supplied from the data bus 27 to the unit 205 in the CPU 2. In this case, the flow advances from FIG. 2, step 6 to step 7, and the unit 205 increments the content of the counter 3 by one through the signal line 17. Note that the content of the counter 3 is cleared to 0 through the signal line 18 at the beginning of the flow chart shown in FIG. 2. Then, the flow advances to FIG. 2, step 4, and the content of the i register 201 is decremented by one by the unit 206. The content M(13) in the buffer 801 at the corresponding address is read out to the B buffer 5, and is compared with the space code in the same manner as described above. Thus, the processing of FIG. 2, step 4 to step 7 is repeated, and the content of the buffer 801 is read out in the order of 14th, 13th, 12th, 11th, 10th, 9th and 8th digits. When the seventh digit is read out, the content M(7) is the SP code, as shown in FIG. 3, and the comparator 6 generates a coincidence signal. Thus, the leftmost code of the numeral string is detected to be located at the right of the SP code. At this time, the content of the "i" register 201 indicates the address i=7 of the SP code at the left of the leftmost code of the numeral string in the input buffer 801.

Since the content of the counter 3 is successively decremented by one while the content of the input buffer 801 is read out from the 14th digit to the 8th digit, it represents that the number of characters included in the numeral string is 7. In this manner, by the operation of FIG. 2, step 2 to step 6, the address a=15 of the DT code in the buffer 801, the address (i=7) of the SP code therein and the number of characters ("7") included in the numeral string are detected.

Then, the decimal point address in the input buffer 801 is detected. The decimal point code is read out from the ROM 7 and is set in the A buffer 4 (FIG. 2, step 8). Since the content of the "i" register 201 is the address (i=7) of the SP code, the content M(i) of the buffer 801 is read out in the right direction from the 8th digit, and is set in the B buffer 5. Then, the content of the buffer 4 and 5 are compared by the comparator 6. The above operation is repeated so as to read out the contents M(8), M(9), M(10), . . . (FIG. 2, step 9→step 10→step 11→step 12 step 9 ) while incrementing the content of the "i" register 201 as the read address of the buffer 801 by one (FIG. 2, step 9). When the content of the "i" register 201 reaches "11", since the readout content M(11) is equal to the decimal point code, as shown in FIG. 3, a coincidence signal is generated from the comparator 6, and the control flow advances from FIG. 2, step 11 to step 13. The content i=11 of the register 201 becomes the address of the decimal point code in the input buffer 801.

The address of the decimal point code detected in this manner is shifted to the DT position set in the memory 9 in advance so as to detect a shift amount for printing. First, the DT position is read out from the memory 9, and is set in the c register 203 (FIG. 2, step 13). The "C" register 203 stores an address amount to be shifted, as will be described later. In the case of an example shown in FIG. 3, the DT position is set at the 15th digit (c=15). A difference (c−i) between the DT position based upon the printing format, i.e., the content of the register 203 and the address of the decimal point code in the input buffer 801, i.e., the content of the "i" register 201 is calculated by the operational unit 206, and the calculation result is set in the register 203 (FIG. 2, step 14). The updated content of the register 203 is equal to the address amount to be shifted when the numeral string read out from the buffer 801 is printed to be aligned with the DT position. In FIG. 3, the shift amount c−i (15−11=4) is set in the register 203. That is, the decimal point code at the 11th digit in the buffer 801 is shifted by four digits and is to be printed at the 15th digit. Then, the address of the rightmost numeral code in the numeral string is calculated by the unit 206. Since this address corresponds to a value obtained by subtracting 1 from the address of the DT code in the buffer 801 (i.e., the digit at the left of the DT code), 1 is subtracted from the content of the register 202 in which the address of the DT code is set, and the updated value is set in the register 202 (FIG. 2, step 15). That is, the new content of the register 202 corresponds to the address of the rightmost numeral code in the buffer 801. In the case of FIG. 3, since the rightmost numeral code is 6 and the address thereof is 14, this yields a=14. Subsequently, the address of the rightmost numeral code on the printing format when the decimal point is aligned at the DT position is calculated. For this purpose, the content of the register 202 as the address of the rightmost numeral code is added to the content of the register 203 as the shift amount by the unit 206, and the result is set in the "b" register 204 (FIG. 2, step 16). In this manner, by the operation of FIG. 2, step 13 to step 16, the rightmost numeral code M(14)=6 at the address "14" in the buffer 801 is shifted in the right direction by four digits on the printing format, and is to be printed on the 18th digit, as can be seen from FIG. 3.

Figure 2:
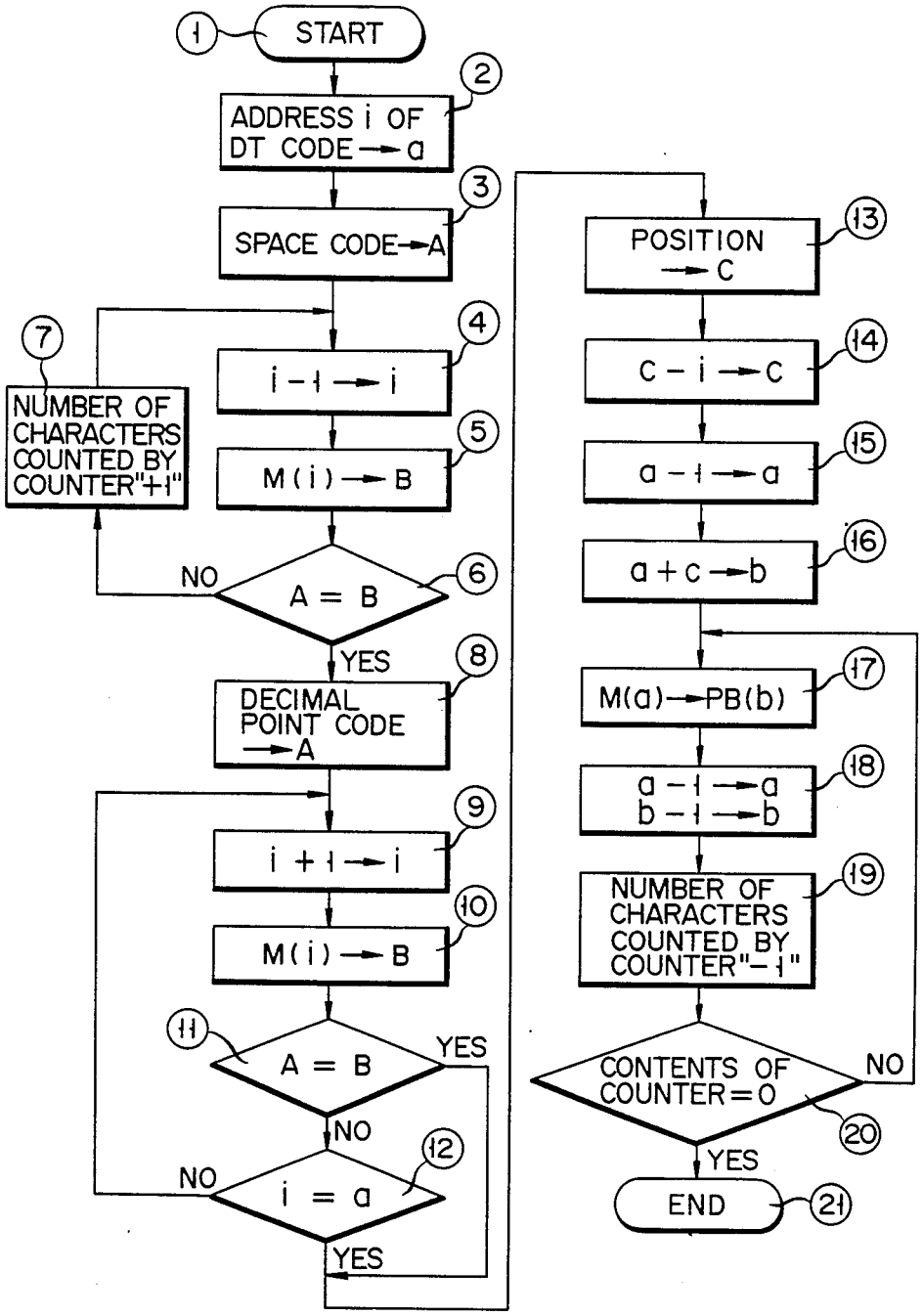
FIG. 2 is a flow chart for explaining an operation of the printing apparatus shown in FIG. 1.
Figure 3:
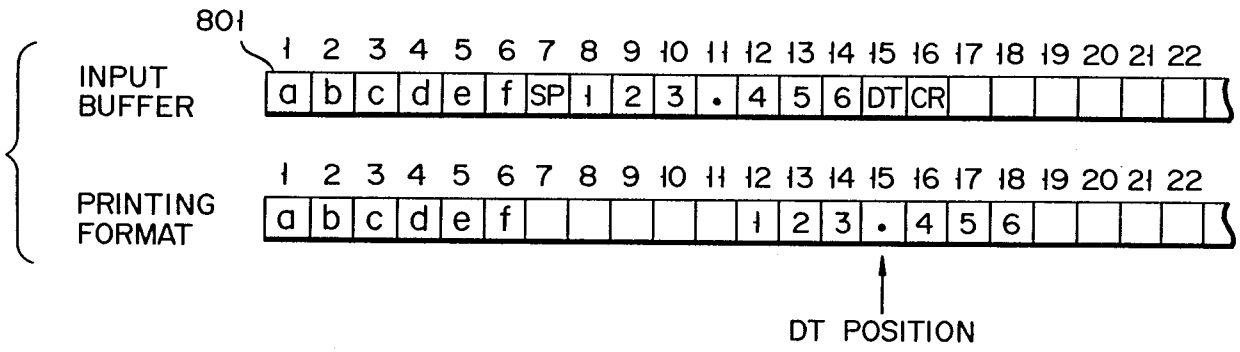
FIGS. 3 and 4 are illustrations for explaining an operation for printing data stored in an input buffer shown in FIG. 1 in accordance with a printing format.

The unit 205 reads out the numeral code M(a) from the address of the buffer 801 corresponding to the content a=14 of the register 202, and supplies the readout code to the PB buffer 1001 in the controller 10 through the buses 16 and 21 (FIG. 2, step 17). At this time, the unit 205 generates the content of the register 204 as the address on the printing format (the above operation is expressed as M(a)→PB(b)). Thus, as described above, the rightmost numeral code M(14)=6 as the content of the register 202 in the input buffer 801 is transferred to the controller 10, and thereafter, numeral "6" is printed at the 18th digit by the unit 11 based upon the content (=18) of the register 204 transferred at the same time. After the numeral "6" is printed, a print end signal PE is supplied to the CPU 2 through the signal line 22. The unit 205 causes the unit 206 to decrement the contents of the registers 202 and 204 by one, respectively (FIG. 2, step 18). At the same time, the content of the counter 3 is decremented by one through the signal line 20 (FIG. 2, step 19), and the flow returns from step 20 to step 17. In the case of FIG. 3, since a=13 and b=17, the numeral code M(13)=5 at the address 13 in the buffer 801 is transferred to the controller 10 as M(13)→PB(17), and numeral "5" is printed at the 17th digit by the unit 11.

The above operation is repeated until the content of the counter 3 reaches 0.

As can be understood from the above description, since the number of characters=7 is stored as an initial value of the counter 3, the numeral string "123.456" stored at the addresses 8 to 14 in the buffer 801 is printed at the 12th to 18th digits in the order from the higher to lower digits. At this time, as shown in FIG. 3, the position of the decimal point is properly aligned at the DT position.

In this manner, when the numeral string consisting of seven characters is printed having the decimal point aligned at the DT position, decimal tab processing is completed (FIG. 2, step 21). Thereafter, the normal printing operation of characters at the first to 6th digits in FIG. 3 is performed based on the corresponding printing format.

Figure 4:
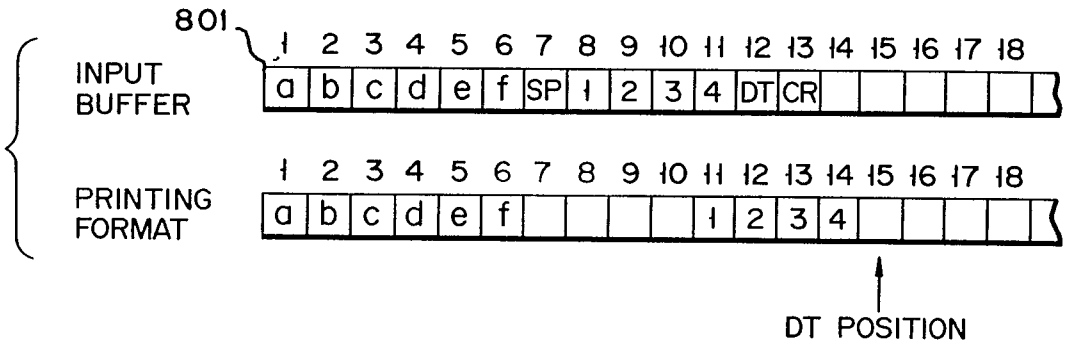

Next, a case will be described wherein a numeral string "1234" having no decimal point is printed to be aligned at the left neighboring digit of the decimal tab position (the 15th digit), as shown in FIG. 4. In this case, in the flow chart shown in FIG. 2, the decimal point code cannot be detected in step 11, and instead, the DT code is detected in step 12 and the address of the DT code is set as the content of the "i" register 201. Thereafter, since the same operation as described above is performed, the right end of the numeral string is aligned at the left neighboring digit of the DT position. That is, in FIG. 4, numeral "4" in the numeral string "1234" in the buffer 801 is printed at the left neighboring digit of the 15th digit as the DT position on the printing format.

As described above, when a numeral string includes a decimal point, printing is performed so that the decimal point is aligned at the DT position. On the other hand, when a numeral string does not include a decimal point, the right end of the numeral string is aligned at the left neighboring digit of the DT position.

Note that in the above operation, a precise printing position of the unit 11 is controlled by a timing pulse TP supplied from the unit 11 to the controller 10 through the signal line 24.

Although a display operation is not particularly explained, a proper display operation of document data is performed using the CPU 2, the display controller 12 and a display 13.

In the above embodiment, a numeral string with or without a decimal point has been exemplified as a character string to be aligned at the DT position. However, the character string is not limited to a numeral string. The right end of a character or symbol string can be adjusted, or input data can be adjusted using a special symbol instead of a decimal point.

What is claimed is:

1. A printing apparatus including tab position placement control, comprising:

tab setting means for setting a predetermined digit position as a tab position along a print line comprised of a number of digit positions, with respect to a character data string to be printed on said print line;

means for inputting the character data string, and for inputting tab data designating execution of a tab operation after inputting of the character data string;

memory means, coupled to said inputting means, for storing at specific addresses each character of the character data string and the tab data for designating execution of the tab operation, wherein said specific addresses each correspond to a digit position of the associated character in the character data string as inputted by said inputting means;

processor means including address converting means for converting the specific addresses of certain characters in the character data string as stored in said memory means, based upon the predetermined digit position set by said tab setting means and after the tab data designating execution of a tab operation is inputted; and printing means coupled to said processor means for printing the character data string, said printing means including buffer means for storing said certain characters of said character data string at addresses corresponding to the addresses converted by said address converting means so that the printed character data string aligns with the tab position set by the tab setting means at said predetermined digit position along said print line.

2. An apparatus according to claim 1, wherein said processor means includes means for causing said printing means to perform printing so that a decimal point position corresponds to the digit position set by said tab setting means when the character data string includes a decimal point, and to perform printing so that a right end of the character data string corresponds to the predetermined digit position set by said tab setting means when the character data string does not include a decimal point.

* * * * *